US007823721B2

(12) United States Patent
Sutherland et al.

(10) Patent No.: US 7,823,721 B2
(45) Date of Patent: Nov. 2, 2010

(54) PACKAGE FOR CONTAINERS

(75) Inventors: Robert L. Sutherland, Kennesaw, GA (US); Colin P. Ford, Woodstock, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 12/253,485

(22) Filed: Oct. 17, 2008

(65) Prior Publication Data

US 2009/0101526 A1 Apr. 23, 2009

Related U.S. Application Data

(60) Provisional application No. 60/981,025, filed on Oct. 18, 2007.

(51) Int. Cl.
*B65D 75/00* (2006.01)

(52) U.S. Cl. ..... 206/153; 206/161; 206/162; 206/427; 229/117.19; 229/117.13

(58) Field of Classification Search ..... 206/148, 206/153, 158, 161, 162, 199, 200, 427, 428, 206/434; 229/117.19, 117.13, 117.14; 294/87.2
See application file for complete search history.

(56) References Cited

U.S. PATENT DOCUMENTS 1,527,399 A * 2/1925 Davidson ..... 229/117.14
2,289,859 A * 7/1942 Arthur ..... 206/175
2,522,950 A * 9/1950 Keith ..... 206/143
2,798,603 A * 7/1957 Grinspoon ..... 206/153
2,950,041 A * 8/1960 Stone ..... 206/147
3,528,697 A * 9/1970 Wood ..... 294/87.2
3,897,873 A * 8/1975 Graser ..... 206/153
3,942,631 A 3/1976 Sutherland et al.
4,304,329 A 12/1981 Graser
4,372,599 A * 2/1983 Kiedaisch et al. ..... 294/87.2
4,378,879 A * 4/1983 Killy ..... 206/158
5,139,147 A 8/1992 Sutherland
5,267,644 A * 12/1993 Tsao ..... 206/151
5,297,673 A 3/1994 Sutherland
5,310,050 A 5/1994 Sutherland
5,310,051 A 5/1994 Sutherland
5,323,895 A 6/1994 Sutherland et al.
5,328,024 A 7/1994 Sutherland
5,351,815 A 10/1994 Fogle et al.
5,351,816 A 10/1994 Sutherland et al.

(Continued)

FOREIGN PATENT DOCUMENTS

JP 2003-146359 5/2003

OTHER PUBLICATIONS

International Search Report and Written Opinion—PCT/US2008/080279, mailed Dec. 18, 2008—Graphic Packaging International, Inc. (applicant).

(Continued)

*Primary Examiner*—David T Fidei
(74) *Attorney, Agent, or Firm*—Womble Carlyle Sandridge & Rice, PLLC

(57) ABSTRACT

A package for holding a plurality of containers. The package has a top panel and side panels. The package has retention features for retaining the containers and handle features for grasping and lifting the package.

23 Claims, 13 Drawing Sheets

U.S. PATENT DOCUMENTS

| | | | | |
|---|---|---|---|---|
| 5,351,817 | A | | 10/1994 | Sutherland |
| 5,355,999 | A | | 10/1994 | Sutherland |
| 5,360,104 | A | | 11/1994 | Sutherland |
| 5,390,784 | A | | 2/1995 | Sutherland |
| 5,407,065 | A | | 4/1995 | Sutherland |
| 5,415,278 | A | | 5/1995 | Sutherland |
| 5,443,153 | A | | 8/1995 | Sutherland |
| 5,445,262 | A | | 8/1995 | Sutherland |
| 5,452,799 | A | | 9/1995 | Sutherland |
| 5,503,267 | A | | 4/1996 | Sutherland |
| 5,520,283 | A | | 5/1996 | Sutherland |
| 5,524,756 | A | | 6/1996 | Sutherland |
| 5,551,566 | A | | 9/1996 | Sutherland |
| 5,593,027 | A | | 1/1997 | Sutherland |
| 5,746,310 | A | | 5/1998 | Slomski |
| 5,816,391 | A | * | 10/1998 | Harris ..... 206/147 |
| 5,960,945 | A | | 10/1999 | Sutherland |
| 6,059,099 | A | * | 5/2000 | Galbierz ..... 206/151 |
| 6,315,111 | B1 | | 11/2001 | Sutherland |
| 6,896,130 | B2 | | 5/2005 | Theelen |
| 7,011,209 | B2 | | 3/2006 | Sutherland et al. |
| 2002/0195371 | A1 | | 12/2002 | Brown |
| 2003/0080004 | A1 | | 5/2003 | Olsen et al. |
| 2003/0213705 | A1 | | 11/2003 | Woog |
| 2005/0127151 | A1 | * | 6/2005 | Johnson ..... 229/117.14 |

OTHER PUBLICATIONS

International Search Report and Written Opinion—PCT/2009/061594, mailed Feb. 5, 2010—Graphic Packaging International, Inc. (applicant).

* cited by examiner

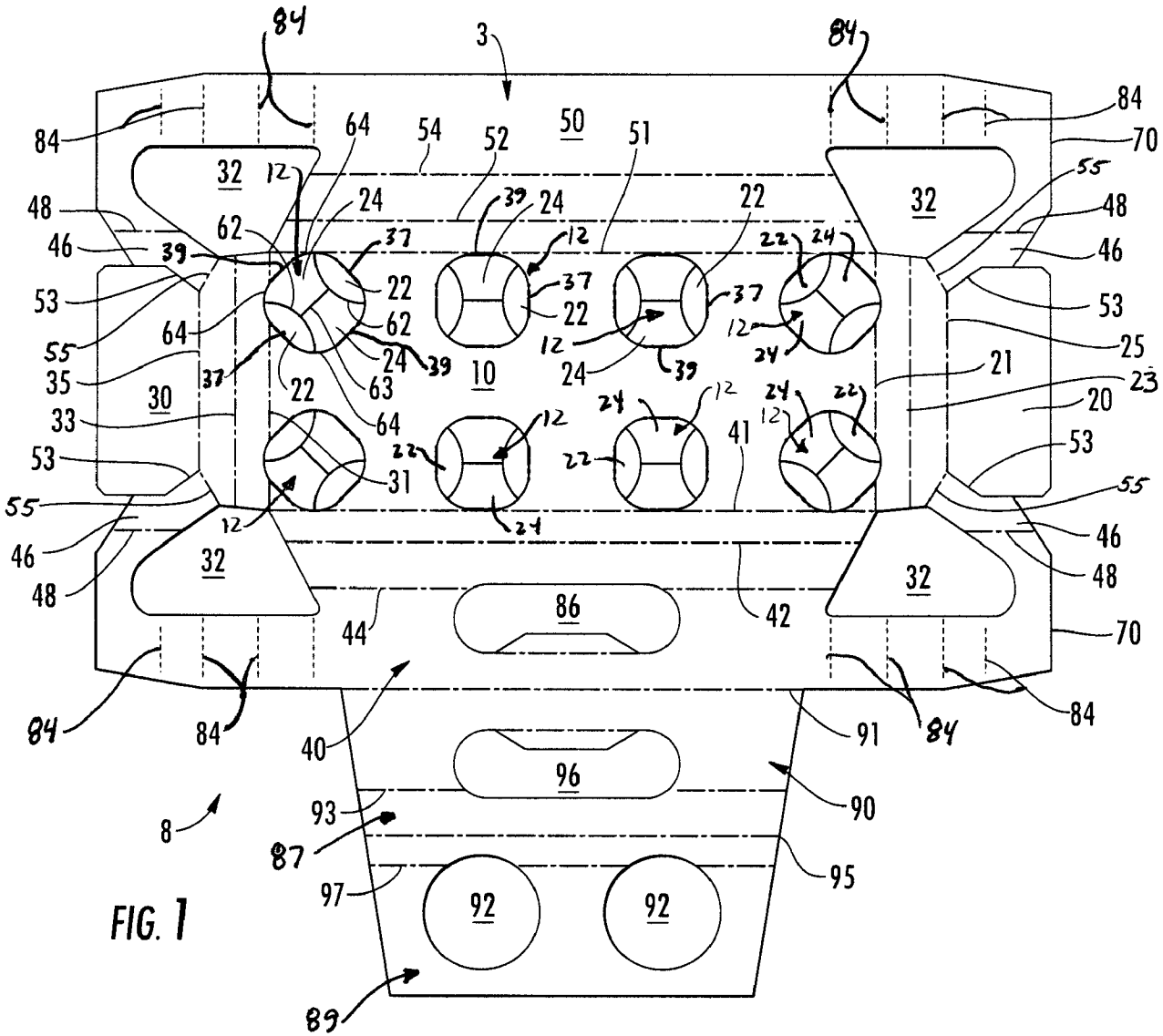
FIG. 1
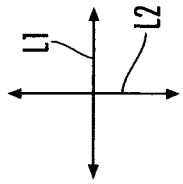

PACKAGE FOR CONTAINERS

CROSS-REFERENCE TO RELATED APPLICATION

This application claims the benefit of U.S. Provisional Application No. 60/981,025, which was filed on Oct. 18, 2007. The entire contents of the above-referenced provisional application is hereby incorporated by reference for all purposes as if presented herein in their entirety.

BACKGROUND OF THE DISCLOSURE

The present disclosure generally relates to packages or cartons for holding and carrying containers.

SUMMARY OF THE DISCLOSURE

In general, one aspect of the disclosure is generally directed to a package for holding a plurality of containers. The package has a top panel and a side panel. The package has retention features for retaining the containers and handle features for grasping and lifting the package.

In another aspect, the disclosure is generally directed to a package for containing a plurality of articles, the package comprising panels that extend at least partially around an interior of the package. The panels comprise a top panel and a side panel foldably connected to the top panel. At least one opening in the top panel is for at least partially receiving at least a portion of one of the articles. A reinforcement flap is foldably connected to the side panel and positioned relative to the side panel for reinforcing the side panel. A handle is in the side panel and the reinforcement flap. The handle is adapted for use in grasping and carrying the carton.

In another aspect, the disclosure is generally directed to a blank for forming a package for containing a plurality of articles. The blank comprises panels that comprise a top panel and a side panel foldably connected to the top panel. At least one opening is in the top panel. A reinforcement flap is foldably connected to the side panel for positioning relative to the side panel and reinforcing the side panel. Handle features are in the side panel and the reinforcement flap. The handle features are for use in grasping and carrying the package formed from the blank.

In another aspect, the disclosure is generally directed to a method of forming a package. The method comprising providing a blank comprising a top panel, a side panel foldably connected to the top panel, a plurality of openings in the top panel, a reinforcement flap foldably connected to the side panel for positioning relative to the side panel and reinforcing the side panel, and handle features in the side panel and the reinforcement flap. The method further comprising positioning a plurality of articles relative to the blank and positioning the blank relative to the articles so that the plurality of articles are at least partially received in respective openings of the plurality of openings. The method further comprising folding the reinforcement flap to be in face-to-face contact with the side panel and downwardly folding the side panel relative to the top panel to at least partially enclose the articles in an interior space of the package.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale.

Dimensions of various features and elements in the drawings may be expanded or reduced to more clearly illustrate the embodiments of the disclosure.

BRIEF DESCRIPTION OF THE DRAWINGS

FIG. 1 is a plan view of an exterior side of a blank used to form a package according to a first embodiment of the disclosure.

Corresponding parts are designated by corresponding reference numbers throughout the drawings.

DETAILED DESCRIPTION OF THE EXEMPLARY EMBODIMENTS

Figure 2:
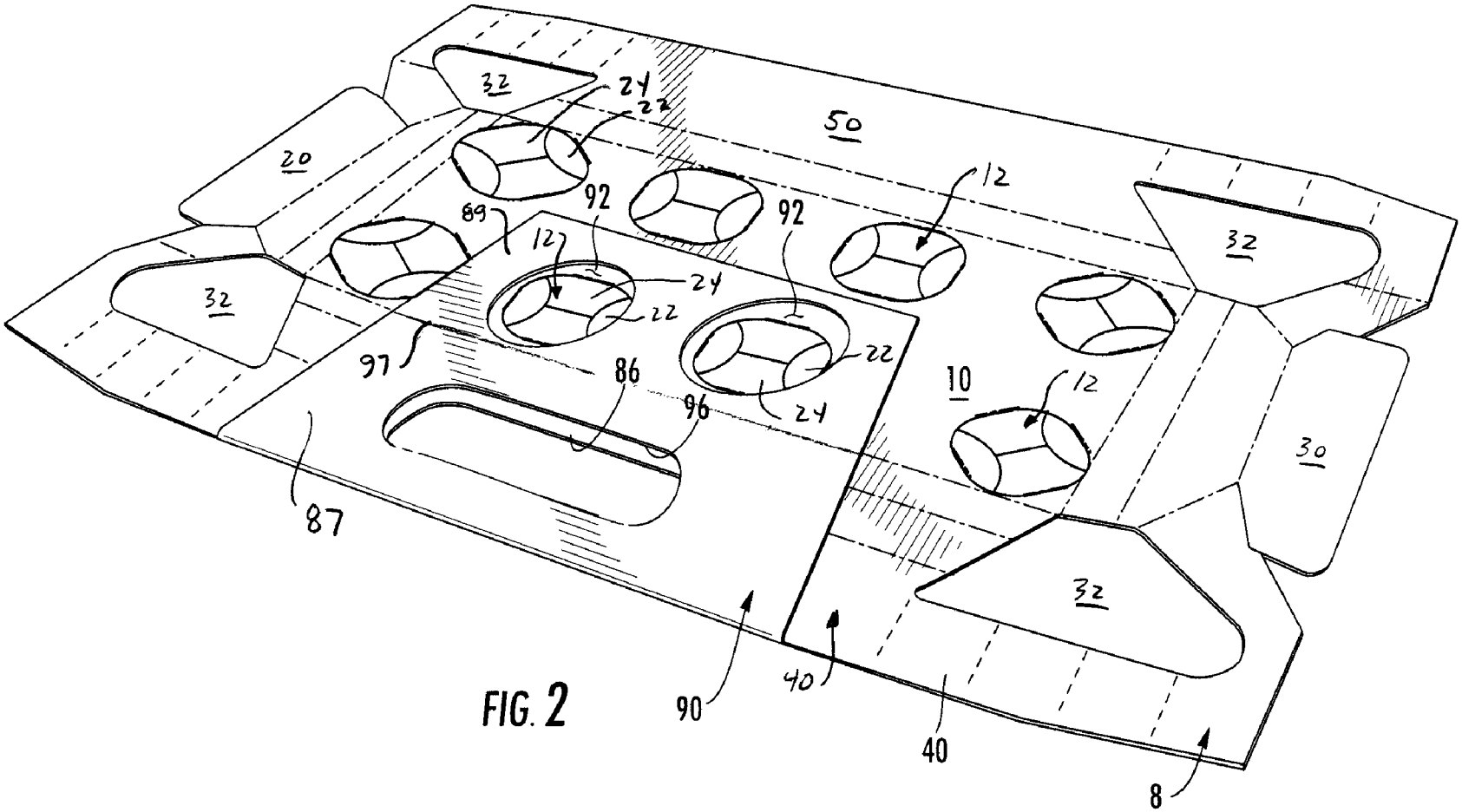
FIG. 2 is a view of an interior side of the blank of FIG. 1 partially erected into the package.

The present disclosure generally relates to constructs, sleeves, cartons, or the like, and packages for holding and displaying containers such as jars, bottles, cans, etc. The containers can be used for packaging food and beverage products, for example. The containers can be made from materials suitable in composition for packaging the particular food or beverage item, and the materials include, but are not limited to, plastics such as PET, LDPE, LLDPE, HDPE, PP, PS, PVC, EVOH, and Nylon; and the like; aluminum and/or other metals; glass; or any combination thereof.

Packages according to the present disclosure can accommodate containers of numerous different shapes. For the purpose of illustration and not for the purpose of limiting the scope of the disclosure, the following detailed description describes beverage containers (e.g., plastic containers) at least partially disposed within the package embodiments. In this specification, the terms "lower," "bottom," "upper" and "top" indicate orientations determined in relation to fully erected packages.

The present embodiments are addressed to cartons or packages for attachment to and accommodation of containers. A package or carrier 150 (FIG. 6) is illustrated in its erected state in FIG. 5, in which it is attached to containers C arranged in two rows of four containers. In the illustrated embodiments the containers C are illustrated as beverage containers having a top portion generally comprising a flange portion F (FIG. 3), an upper neck portion N, and a cap CP, but containers of other sizes, shapes, and configurations, may be held in the package 150 without departing from the disclosure. The upper neck portions N of the containers C are received in respective openings 18 in the package 150 and retained in the package by retaining features described further herein. The containers could be arranged in other than a 2×4 arrangement (e.g., 2×3, 1×3, 1×4, etc.) without departing from the disclosure. In the illustrated embodiment, the package 150 includes a handle 7 (FIG. 5) for grasping and carrying the package. The handle 7 includes various features including reinforcement features as further described herein.

FIG. 1 is a plan view of an exterior side 3 of a blank 8 used to form the package or carrier 150. The blank 8 has a longitudinal axis L1 and a lateral axis L2. The blank 8 comprises a top panel 10 foldably connected to a first end panel 20 at a first lateral fold line 21 and foldably connected to a second end panel 30 at a second lateral fold line 31. A first side panel 40 is foldably connected to the top panel 10 at a first longitudinal fold line 41. A second side panel 50 is foldably connected to the top panel 10 at a second longitudinal fold line 51.

Figure 5:
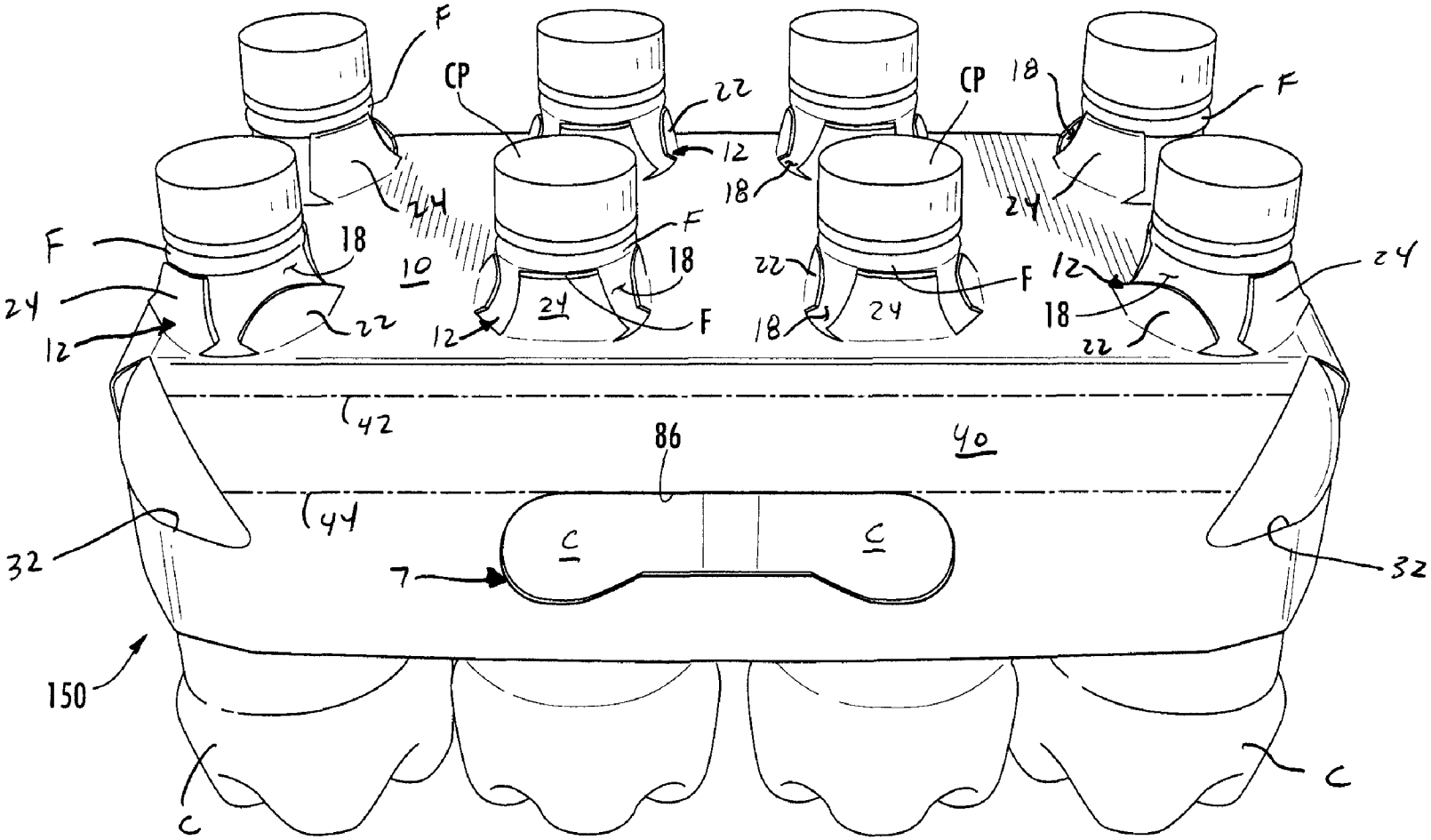
FIG. 5 is a side perspective of the package formed from the blank of FIG. 1.
Figure 6:
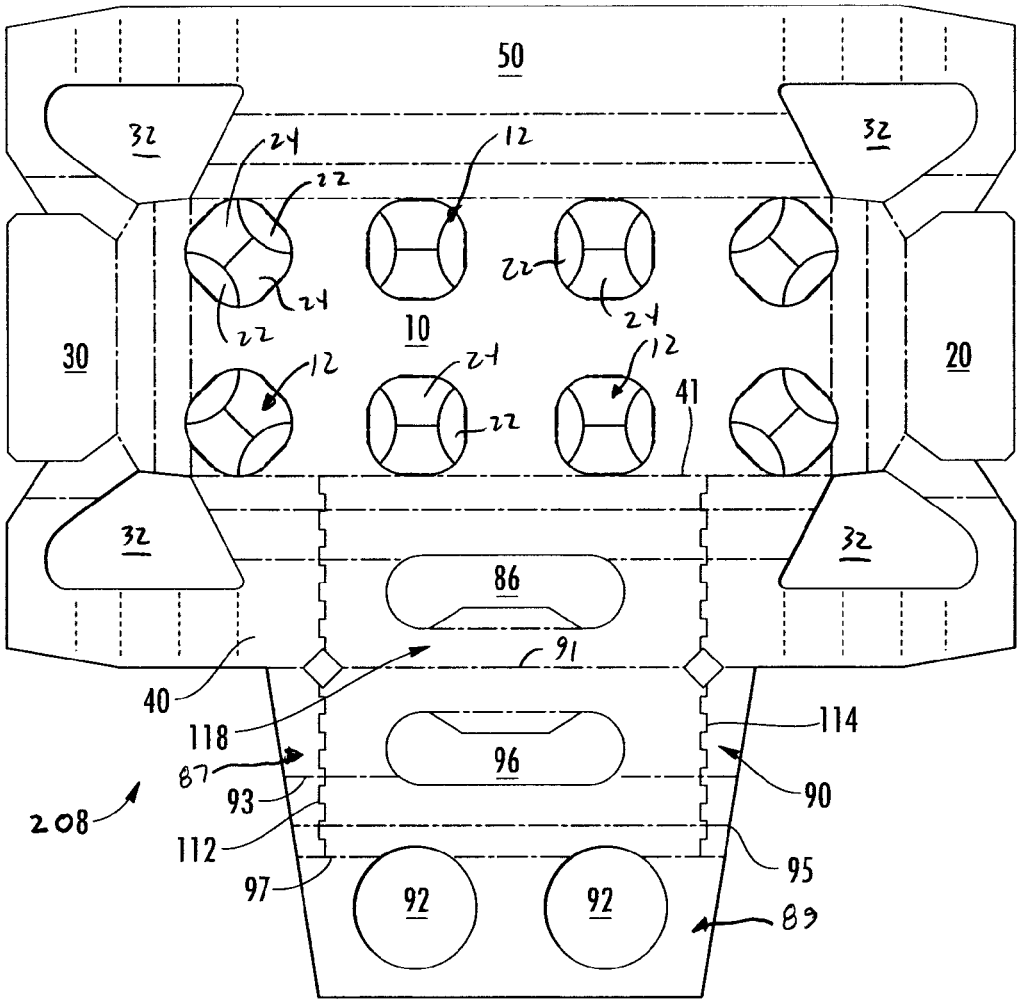
FIG. 6 is a plan view of an exterior side of a blank used to form a package according to a second embodiment.
Figure 7:
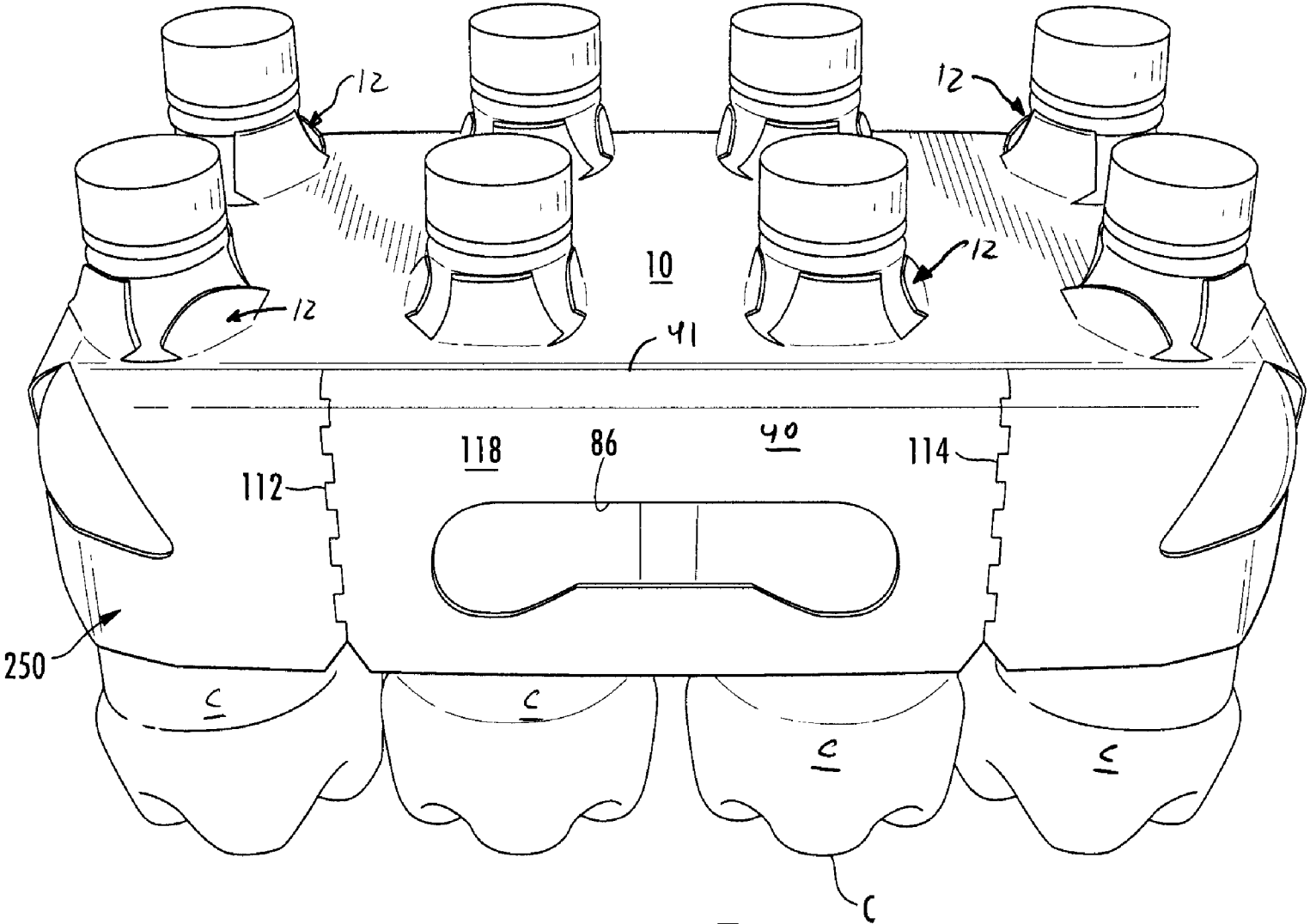
FIG. 7 is a side perspective of the package formed from the blank of FIG. 6.
Figure 8:
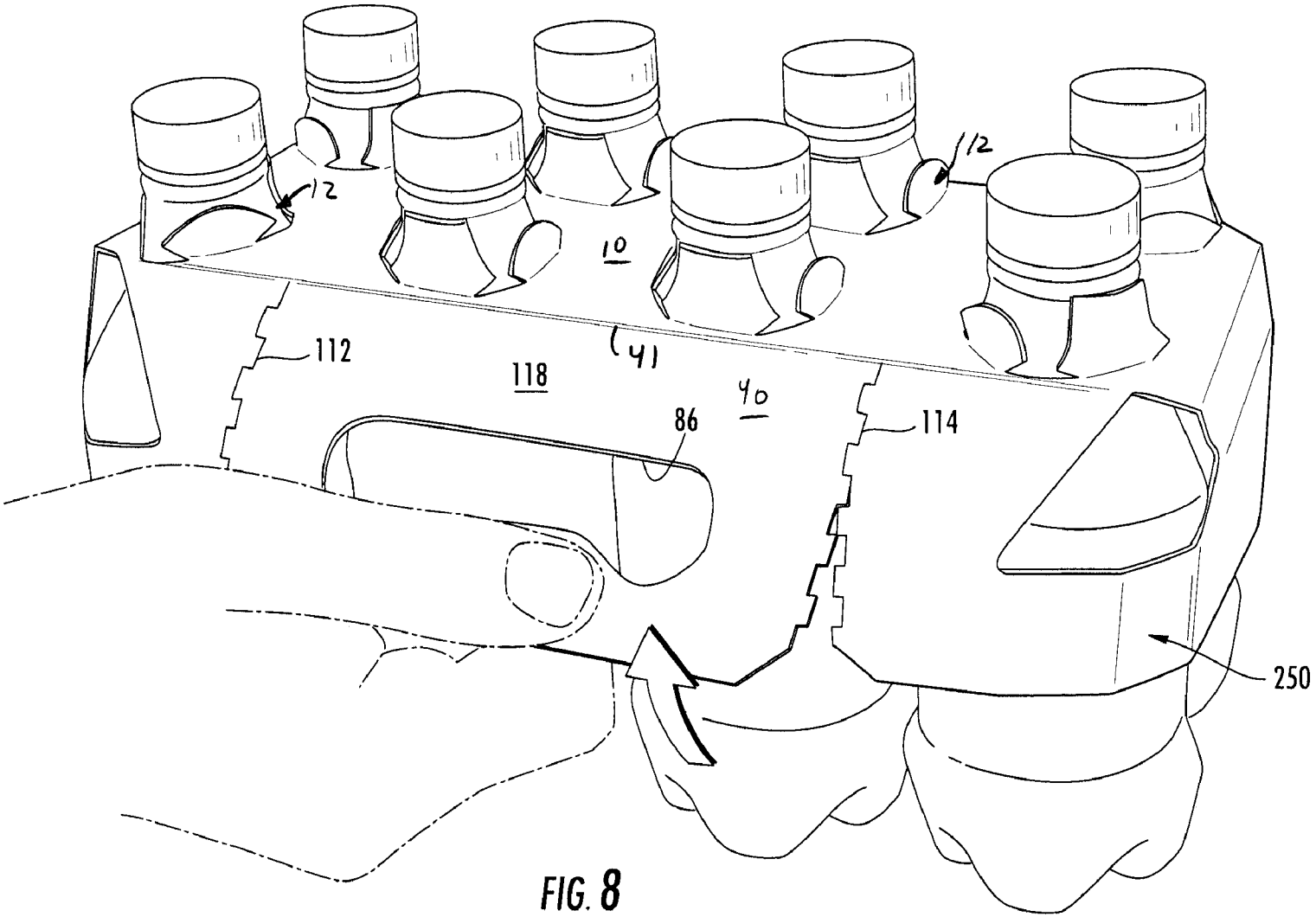
FIG. 8 is a view showing a handle of the package of FIG. 7 being raised.
Figure 9:
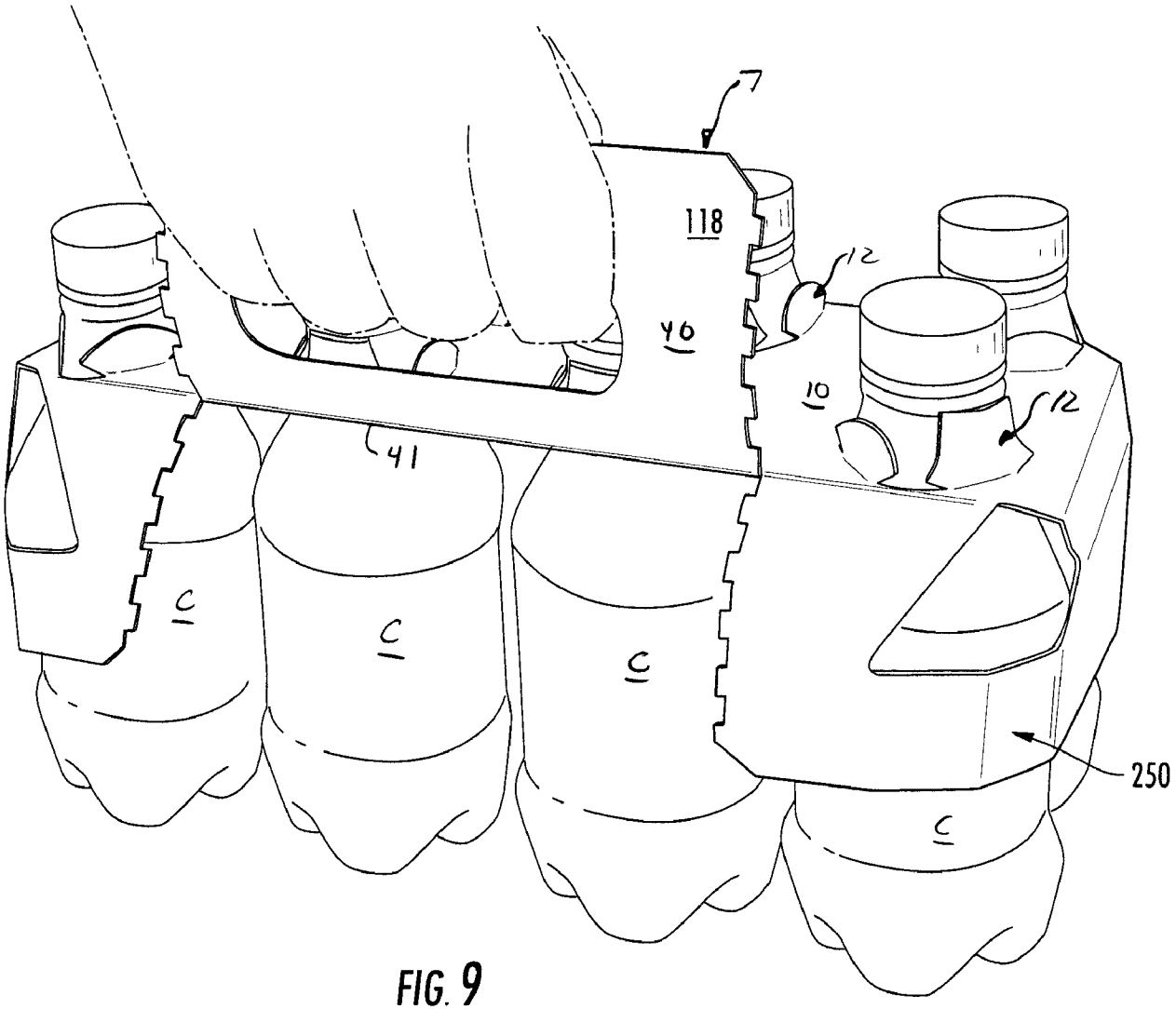
FIGS. 9 and 10 are views showing the handle of FIG. 8 raised and the package being carried at the handle.
Figure 10:
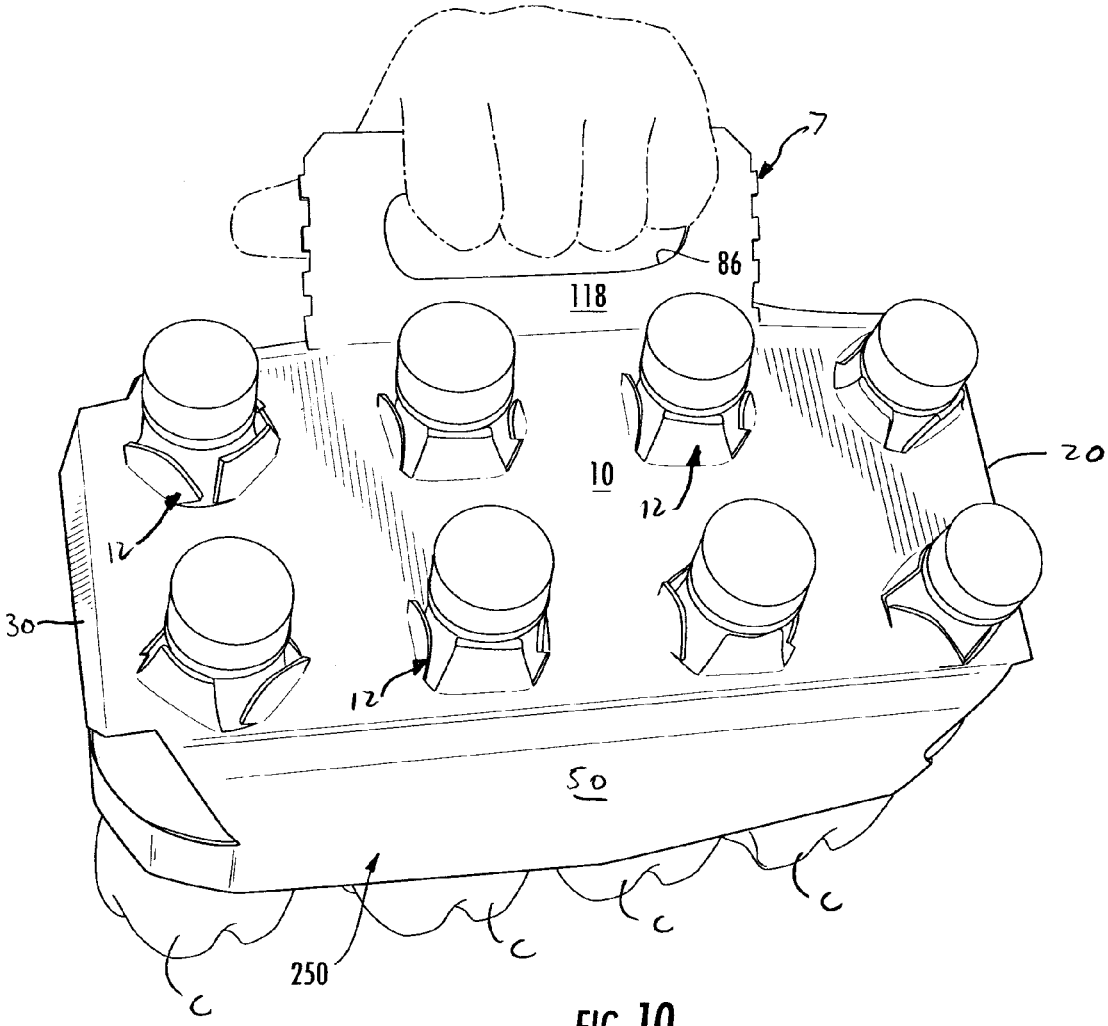

In the illustrated embodiment, the blank 8 includes eight receptacles 12 formed by tabs 22 and 24, which are connected to the top panel 10 by respective fold lines 37, 39. Slits 62 and 63 separate the tabs 22, 24 and arcuate slits 64 separate the tab fold lines 37, 39. The arcuate slits 64 and tab fold lines 37, 39 extend around and define a periphery of each of the openings 18 in the top panel 10. As shown in FIG. 5, the tabs 22, 24 surrounding each opening 18 are of different sizes so that when containers C are inserted into the openings 18 and the tabs 22, 24 are upwardly struck from the top panel 10, the shorter tabs 22 contact only the necks N of the containers and the longer tabs 24 contact both the necks and the underside of the flanges F to support the containers when the carrier is lifted. A variety of different configurations of tabs (e.g., tabs 22, 24) are within the scope of this disclosure.

The diameter of the openings 18 in the top panel 10 is related to the diameter of the neck portion N of the containers C to be packaged so that the containers are able to pass through the opening while contacting the support tabs 22, 24 of the receptacles 12 to pivot the support tabs up about their fold lines. In the illustrated embodiment, the support tabs 22 and 24 at the corner openings 18 are of somewhat different design than the support tabs 22 and 24 at the central openings. In both cases the support tabs 22, 24 take the form of four contiguous tabs arranged so that the fold lines 37, 39 of adjacent tabs are at right angles to each other. In both cases, one pair of oppositely located tabs 24 is longer than the other pair 22. In the illustrated embodiment, the tabs 22, 24, slits 62, 63, 64, and fold lines 37, 39 of the opening 18 at each of the two corners of the top panel 10 adjacent the second end panel 30 are respectively rotated clockwise and counterclockwise approximately 45 degrees from the orientation of the tabs, slits, and fold lines of the four central openings. The tabs 22, 24 , slits 62, 63, 64, and fold lines 37, 39 of the opening 18 at each corner of the top panel 10 adjacent the first end panel 20 are respectively rotated counterclockwise and clockwise approximately 45 degrees from the orientation of the tabs, slits, and fold lines of the four central openings. The openings 18 in the top panel 10 can have other features including other tabs, slits, fold lines, tear lines, etc., and may be otherwise arranged and/or configured, without departing from the disclosure.

The blank 8 includes corner cutouts 32 in respective side panels that extend from the intersection of the lateral fold lines 21, 31 and longitudinal fold lines 41, 51. Longitudinal fold lines 42, 44 in the side panel 40 and longitudinal fold lines 52, 54 in side panel 50 extend between respective cutouts 32 in each side panel to form sloped side panel sections which generally conform to the slope of the containers C in the transition area between the neck N and the flange F of the containers. Additional fold lines 23, 25 in the end panel 20 and additional fold lines 33, 35 in the end panel 30 allow the end panels to conform closely to the contour of the containers C.

In one embodiment, the side panels 40, 50 are longer than the length of the top panel 10, terminating beyond the cutouts 32. Gusset panels 46 are connected to the side panels 40, 50 along longitudinal fold lines 48 and to the end panel panels 20, 30 along oblique fold lines 55. Slits 53 separate the gusset panels 46 from the end panels 20, 30. In the illustrated embodiment, the blank 8 includes groups of the parallel score lines 84 in the side panels 40, 50. The score lines 84 are parallel to the fold lines 21, 31 and extend generally from the cutouts 32 to the outer edge of the side flaps 20, 30. The score lines assist in forming the corners of the package 150 by wrapping the end panels around a respective container C at the corner of the package.

In the embodiment of FIG. 1, the handle features forming the handle 7 include a first handle opening 86 in the first side panel 40 and a reinforcement flap 90 foldably attached to the first side panel at a longitudinal fold line 91. In the illustrated embodiment, the reinforcement flap 90 includes a first portion 87 foldably connected to the first side panel 40 at the fold line 91 and a second, distal portion 89 foldably connected to the first portion at a longitudinal fold line 97. The first portion 87 includes two longitudinal fold lines 93, 95 and a second handle opening 96. The second portion 89 includes two generally circular apertures 92. In the illustrated embodiment, the handle 7 is in the first side panel 40, but in alternative embodiments, the handle could be in one or more of the second side panel 50, the end panels 20, 30, or top panel 10. Further, the terms "top", "side", and "end" indicate orientations determined in relation to the erected package 150 of the illustrated embodiment, and are not intended to limit the scope of the disclosure, as panels, flaps, or portions of the blank 8 could be otherwise orientated or positioned without departing from the disclosure.

To form the package 150 in accordance with one acceptable method, the reinforcement flap 90 is first folded along fold line 91 so that the first portion 87 of the reinforcement flap is in face-to-face contact with a portion of the inner surface of the side panel 40, and the second portion 89 of the reinforcement flap 90 is in face-to-face contact with side panel 40 and the top panel 10 (FIG. 2). As shown in the partially assembled configuration of FIG. 2, apertures 92 in the reinforcement flap 90 overlay and are axially aligned with the tabs 22, 24 and slits 62, 63, 64 of two of the central openings 18. Also, the second handle opening 96 in the reinforcement flap 90 overlies and is aligned with the first handle opening 86 in the side panel 40.

Figure 3:
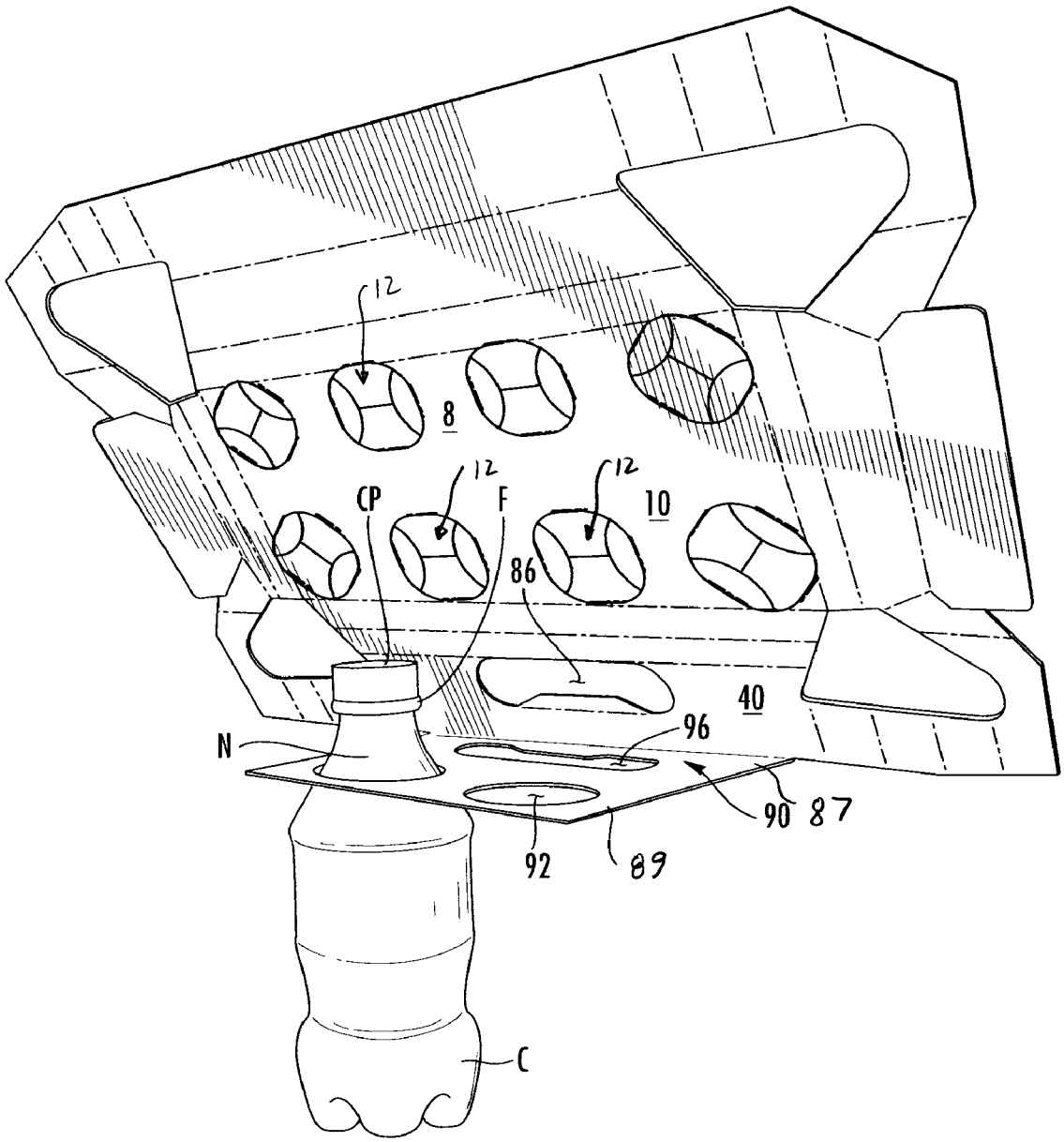
FIG. 3 is a view of the blank of FIG. 1 further partially erected.
Figure 4:
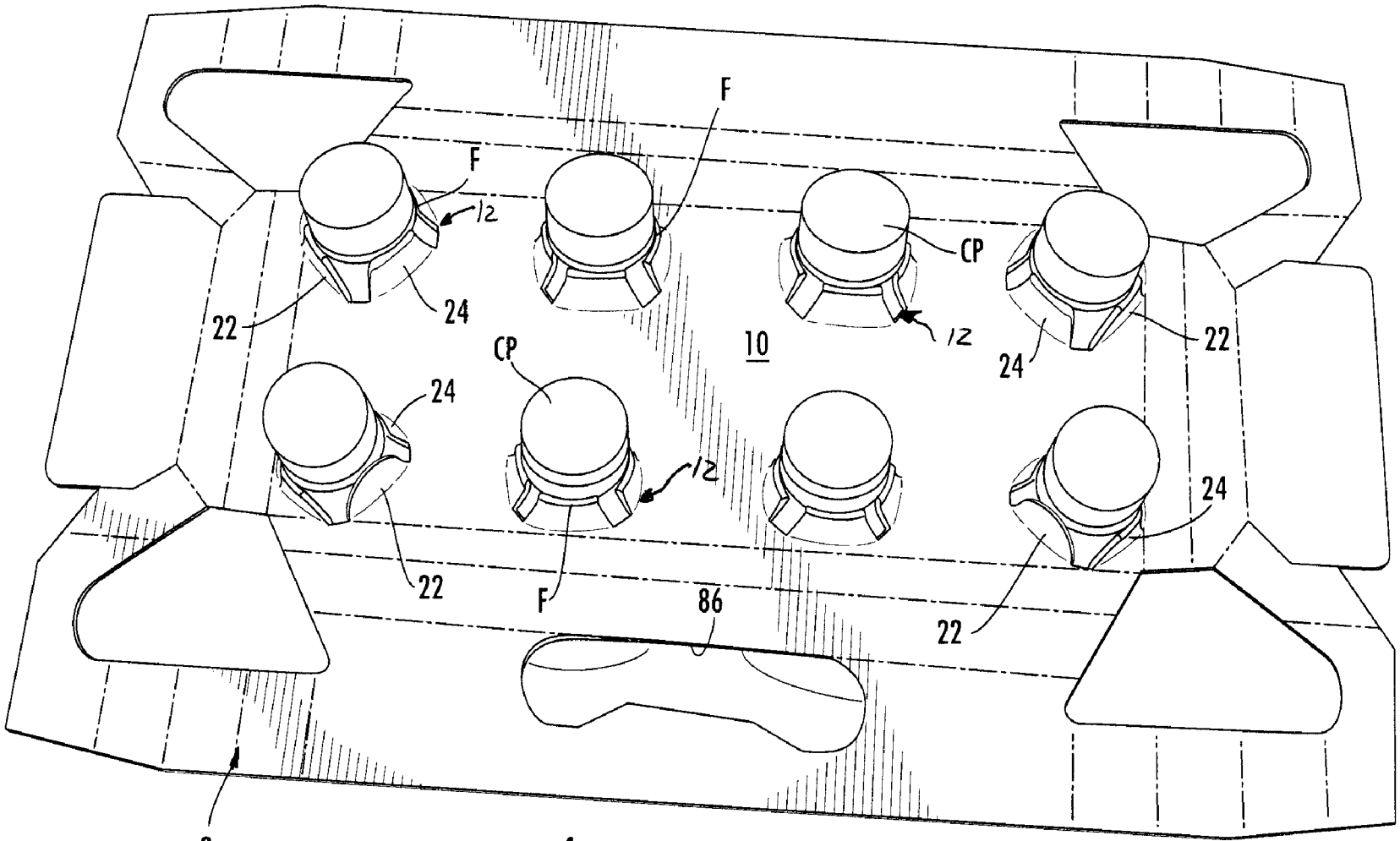
FIG. 4 is a top view of the blank of FIG. 1 further partially erected.

FIG. 3 illustrates a single container C being inserted into one of the apertures 92 for illustration purposes, the remaining containers C to be packaged together in the package 150 have been omitted. After the containers C to be packaged are grouped together and the reinforcement flap 90 is folded, the blank 8 is typically pushed down over the tops of the containers, or the containers can be moved relative to the blank. The caps CP of the containers C contact the support tabs 22, 24 to pivot the support tabs up relative to the top panel 10 to create the openings 18 in the top panel (FIG. 4). Also, two of the containers C move through the apertures 92 of the reinforcement flap 90 before passing through respective openings 18 in the top panel 10. Relative upward movement of the containers C continues until the support tabs 24 snap into place as the edges of these tabs engage the underside of the flanges F (FIG. 5). The shorter tabs 22 do not reach the flanges F but snugly engage the necks N. Next, the gusset panels 46 are folded down about fold lines 55 and up about fold lines 48, causing the gusset panels to contact the underside of the end panels 20, 30. It may be preferred during this step to pivot the end panels 20, 30 up about their fold lines 21, 31 which elevates the fold lines 55 and causes the side panels 40, 50 to automatically begin to fold down about the fold lines 41, 51, thereby facilitating the folding of the gusset panels 46. The end edges 70 of opposite side panels 40, 50 are moved toward each other during this folding sequence, causing the end portions of the side panels to curve around the adjacent corner containers until they are in their final position. The end panels 20, 30 are then folded down and glued to the underlying portions of the side panels 40, 50 to produce the final package 150 shown in FIG. 5.

The fold lines 84 facilitate the curving of the side panels 40, 50 about the corner containers C. Because the side panels 40, 50 follow the contour of the containers C instead of meeting in a folded corner arrangement spaced from the containers, the containers are snugly held in place. The optional cutouts 32 at the corners of the package 150 eliminate material which would tend to be compressed into unsightly irregular creases and folds when the side panels 40, 50 are folded into place, and minimize the size of the gusset panels 46. The cutouts 32 also provide biting edges which contact the containers C, further preventing the containers from moving. Although relatively large cutouts provide these beneficial results, including minimizing the length of the gusset fold lines 48 in order to reduce resistance against folding of the gusset panels 46, the gusset fold lines typically should remain of a length which provides enough force to pull the side panels 40, 50 into place upon folding of the gusset panels. The gusset panels 46 cause the side panels 40, 50 to move into place so as to snugly conform to the curvature of the corner containers C in the package 150 and maintain the end panels 20, 30 in that position prior to gluing the end panels to the end portions or extensions of the side panels 40, 50.

In the illustrated embodiment, the package 150 can be lifted by grasping the handle 7 at the overlapped handle openings 86, 96 in the side panel 40. The reinforcement flap 90 provides the package 150 with extra rigidity in a manner that seeks to prevent tearing or failure of the package when the package is lifted.

FIGS. 6-10 respectively show a blank 208 and a package 250 of a second embodiment of the disclosure having similar features as the blank 8 and package 150 of the first embodiment. Accordingly, similar or identical features of the embodiments are provided with like reference numbers. The handle 7 of the package 250 is foldably connected to the top panel 10 along fold line 41. The blank 208 of the second embodiment includes two lateral tear lines 112, 114 extending from (e.g., substantially from) the fold line 41 to the fold line 97 in the reinforcement flap 90.

In the illustrated embodiment, the tear lines 112, 114 extend across the side panel 40 and across the first portion 87 of the reinforcement flap 90. As shown in FIGS. 7-10, the tear lines 112, 114 define a handle panel 118 of the handle 7 when the first portion 87 of the reinforcement flap 90 is in face-to-face contact with the side panel 40. The handle panel 118 can be raised by tearing along the tear lines 112, 114 and lifting the handle panel upward about fold line 41. The package 250 may be lifted and carried by the handle 7 by grasping the handle panel 118 at overlapped openings 86, 96. The handle 7 could be otherwise shaped, arranged, or configured without departing from the scope of this disclosure.

Figure 11:
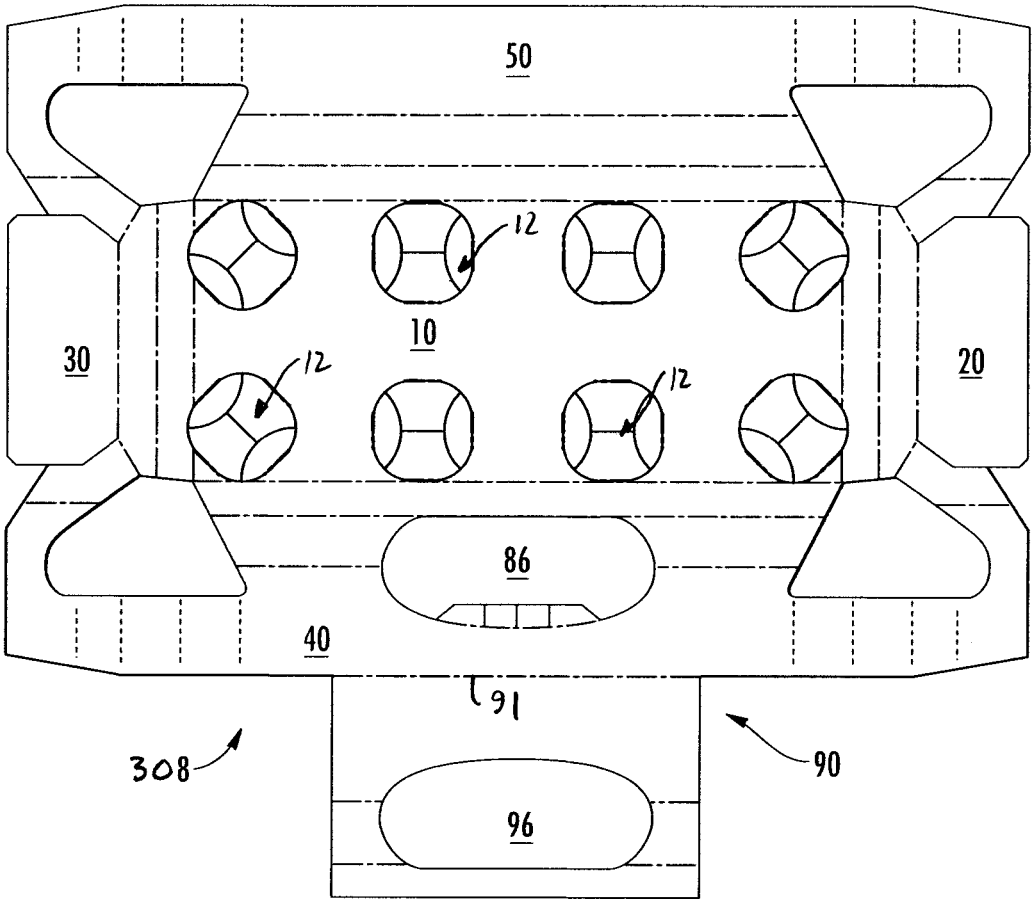
FIG. 11 is a plan view of an exterior side of a blank used to form a package according to a third embodiment.
Figure 12:
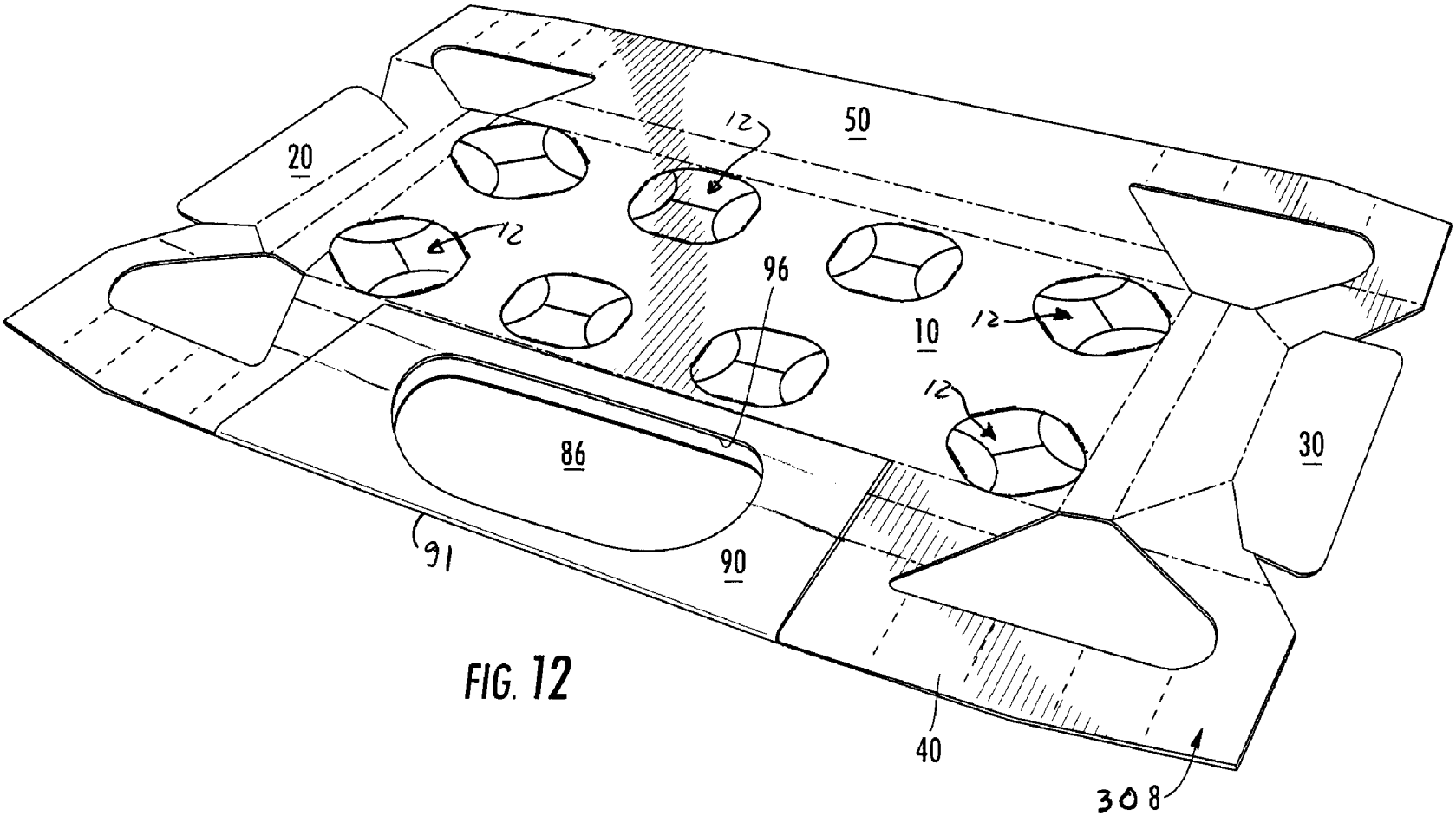
FIG. 12 is a view of an interior side of the blank of FIG. 11 partially erected into the package.

FIGS. 11-12 show a blank 308 for forming a package (not shown) of a third embodiment of the disclosure having similar features as the blank and packages of the previous embodiments. The blank 308 includes a reinforcement flap 90 that is smaller than the reinforcement flap of the first and second embodiments. As shown in FIG. 12, the reinforcement flap 90 of the blank 308 is folded about fold line 91 to be in face-to-face contact with the side panel 40 when the blank is formed into the package. The reinforcement flap 90 of the third embodiment does not overlap a portion of the top panel 10 when the blank 308 is assembled into the package.

Figure 13:
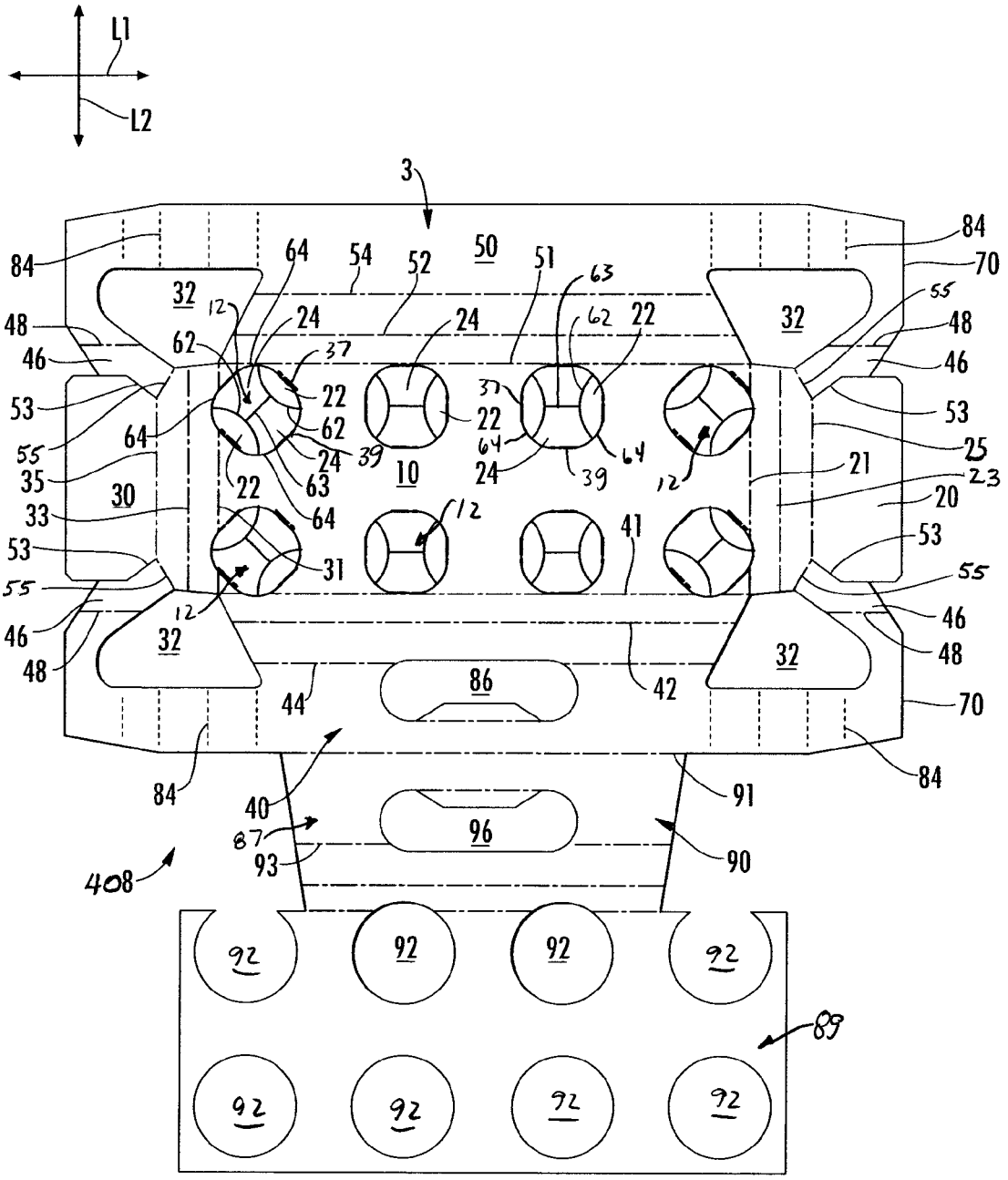
FIG. 13 is a plan view of an exterior side of a blank used to form a package according to a fourth embodiment.

FIG. 13 shows a blank 408 for forming a package (not shown) of a fourth embodiment of the disclosure having similar features as the blank and packages of the previous embodiments. The blank 408 includes a reinforcement flap 90 that is larger than the reinforcement flap of the previous embodiments. As shown in FIG. 13, the reinforcement flap 90 of the blank 408 includes a first portion 87 similar to the first embodiment and a second portion 89 larger than the second portion of the reinforcement flap of the first embodiment. In the embodiment of FIG. 13, the second portion 89 is sized to cover substantially all of the top panel 10 when the reinforcement flap 90 is positioned in face-to-face contact with the top panel. The second portion 89 includes eight openings 92 to correspond with (e.g., being respectively coaxially aligned with and adjacent to) each of the eight openings 18 in the top panel.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc. could be made to the exemplary embodiments without departing from the spirit and scope of the claims. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A package for containing a plurality of articles, the package comprising:

panels that extend at least partially around an interior of the package, the panels comprise a top panel and a side panel foldably connected to the top panel, the side panel and the top panel cooperating to at least partially form the interior of the package;

at least one opening in the top panel for at least partially receiving at least a portion of one of the articles;

a reinforcement flap foldably connected to the side panel and positioned relative to the side panel for reinforcing the side panel; and a handle in the side panel and the reinforcement flap, the handle is adapted for use in grasping and carrying the carton, wherein the handle comprises a first handle opening in the side panel and a second handle opening in the reinforcement flap, at least a portion of the reinforcement flap being positioned in face-to-face contact with the side panel, and the first handle opening being generally aligned with the second handle opening.

2. The package of claim 1 wherein the panels comprise an end panel foldably connected to the top panel, and the end panel is foldably connected to the side panel.

3. The package of claim 2 wherein the package comprises a gusset panel foldably connected to the end panel and foldably connected to the side panel.

4. The package of claim 1 in combination with the articles, the articles comprising beverage containers having an upper portion and a flange, wherein the at least one opening comprises a plurality of openings, each of the openings comprises a periphery and the top panel comprises four tabs foldably attached to the top panel at the periphery of each of the openings.

5. The package of claim 4 wherein the four tabs at each opening comprise two shorter tabs that contact the upper portion of one of the containers and two longer tabs that contact an underside of the flange of the one of the containers to retain the containers in the package.

6. The package of claim 1 wherein the reinforcement flap includes a first portion in face-to-face contact with the side panel and a second portion in face-to-face contact with the top panel.

7. The package of claim 6 wherein the second portion of the reinforcement flap comprises at least two openings, the at least one opening in the top panel comprises at least two openings, the openings in the reinforcement flap being respectively aligned with the openings in the top panel.

8. The package of claim 6 wherein the at least two openings in the top panel comprises eight openings, and the at least two openings in the reinforcement flap comprises eight openings.

9. The package of claim 1 wherein the handle comprises at least one tear line in the reinforcement flap and the side panel, the at least one tear line forming a handle panel that is foldably attached to the top panel.

10. The package of claim 9 wherein the at least one tear line comprises two spaced-apart tear lines, the tear lines extending in a lateral direction across the side panel.

11. The package of claim 10 wherein the reinforcement flap includes a first portion in face-to-face contact with the side panel and a second portion in face-to-face contact with the top panel, and the tear lines extend across the first portion.

12. A blank for forming a package for containing a plurality of articles, the blank comprising:

panels that comprise a top panel and a side panel foldably connected to the top panel, the side panel and the top panel being for cooperating to at least partially form an interior of the package formed from the blank;

at least one opening in the top panel;

a reinforcement flap foldably connected to the side panel for positioning relative to the side panel and reinforcing the side panel; and handle features in the side panel and the reinforcement flap, the handle features being for use in grasping and carrying the package formed from the blank, wherein the handle features comprise a handle having a first handle opening in the side panel and a second handle opening in the reinforcement flap, at least a portion of the reinforcement flap being for positioning in face-to-face contact with the side panel with the first handle opening generally aligned with the second handle opening when the blank is formed into the package.

13. The blank of claim 12 further comprising an end panel foldably connected to the top panel, and a gusset panel foldably connected to the end panel and the side panel.

14. The blank of claim 12 wherein the reinforcement flap includes a first portion for being in face-to-face contact with the side panel and a second portion for being in face-to-face contact with the top panel.

15. The blank of claim 14 wherein the second portion of the reinforcement flap comprises at least two openings, the at least one opening in the top panel comprises at least two openings, the openings in the reinforcement flap being aligned with respective openings in the top panel.

16. The blank of claim 15 wherein the at least two openings in the top panel comprises eight openings, and the at least two openings in the reinforcement flap comprises eight openings.

17. The blank claim 12 wherein the handle features comprise two spaced-apart tear lines extending in a lateral direction across the side panel and into the reinforcement flap, the two tear lines forming a handle panel that is foldably attached to the top panel.

18. The blank of claim 17 wherein the reinforcement flap includes a first portion for being in face-to-face contact with the side panel and a second portion for being in face-to-face contact with the top panel, and the tear lines extend across the first portion.

19. A method of forming a package, the method comprising:

obtaining a blank comprising a top panel, a side panel foldably connected to the top panel, a plurality of openings in the top panel, a reinforcement flap foldably connected to the side panel for positioning relative to the side panel and reinforcing the side panel, and handle features in the side panel and the reinforcement flap, the handle features comprise a handle having a first handle opening in the side panel and a second handle opening in the reinforcement flap;

positioning a plurality of articles relative to the blank;

positioning the blank relative to the articles so that the plurality of articles are at least partially received in respective openings of the plurality of openings;

forming the handle by positioning the reinforcement flap so that at least a portion of the reinforcement flap is in face-to-face contact with the side panel with the first handle opening generally aligned with the second handle opening;

downwardly folding the side panel relative to the top panel to at least partially enclose the articles in an interior space of the package.

20. The method of claim 19 wherein the plurality of articles comprises beverage containers having an upper portion and a flange, wherein each of the openings comprises a periphery and the top panel comprises four tabs foldably attached to the top panel at the periphery of each of the openings, the method comprising attaching the containers to the blank by inserting at least a portion of the containers into respective openings so that at least two of the tabs contact an underside of a flange of a respective container.

21. The method of claim 20 wherein the reinforcement flap includes a first portion and a second portion, the the forming the handle comprises placing the first portion in face-to-face contact with the side panel and placing the second portion in face-to-face contact with the top panel.

22. The method of claim 21 wherein the second portion of the reinforcement flap comprises at least two openings, the method further comprising positioning the reinforcement flap so that at least two of the plurality of articles are received in the respective openings in the reinforcement flap.

23. The method of claim 19 wherein the handle features comprises two spaced-apart tear lines in the side panel and the reinforcement flap, the method further comprising tearing the package along the tear lines to form a handle panel that is foldably attached to the top panel.

* * * * *